United States Patent [19]

Ewert

[11] 4,401,705

[45] Aug. 30, 1983

[54] PLASTIC MOLDING

[76] Inventor: Abram Ewert, 6651 Brooks St., Vancouver, British Columbia, V5S 3J6, Canada

[21] Appl. No.: 359,620

[22] Filed: Mar. 18, 1982

[51] Int. Cl.[3] ..... B32B 3/28; B32B 3/30; B32B 3/22

[52] U.S. Cl. ..... 428/131; 52/309.1; 52/537; 52/588; 52/726; 428/156; 428/182; 428/192

[58] Field of Search ..... 428/182, 131, 192, 156; 52/537, 726, 588, 309.1, 309.13; 264/286

[56] References Cited

U.S. PATENT DOCUMENTS 429,937 6/1890 Mitchell ..... 52/537

2,021,929 11/1935 Voigt ..... 52/537

*Primary Examiner*—Paul J. Thibodeau

*Attorney, Agent, or Firm*—Klarquist, Sparkman, Campbell, Leigh, Whinston & Dellett

[57] ABSTRACT

This invention is directed to a sheet molding and in particular a molding that is used to assist in fastening corrugated fibreglass sheeting to supporting objects. The invention is a pre-fabricated section suitable for use in supporting corrugated sheeting comprising a hollow, open-bottom, elongated, body section, the body section having a corrugated top wall and two generally planar side walls; one or more nail receiving openings penetrating the interior of the corrugated top wall; a tongue located at and projecting from one end of the body section, the tongue having at least one pin projecting vertically from the surface of the tongue that corresponds with the corrugated surface of the body section; and at least one opening in the corrugated surface corresponding in size and respective location with the pin located on the tongue at the opposite end, located at the end of the body section opposite the tongue.

6 Claims, 7 Drawing Figures

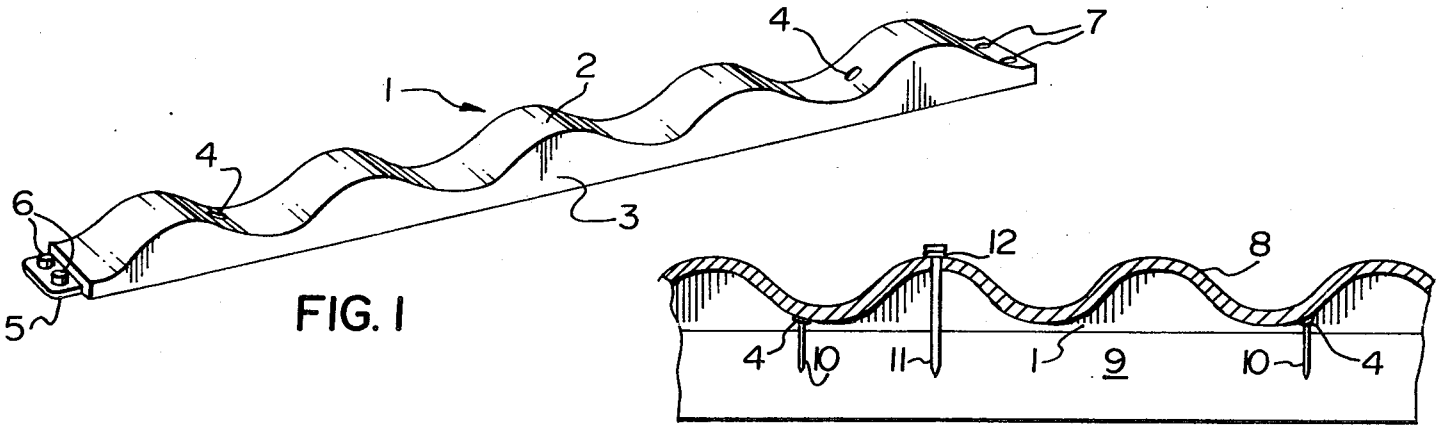
FIG. 1
FIG. 4
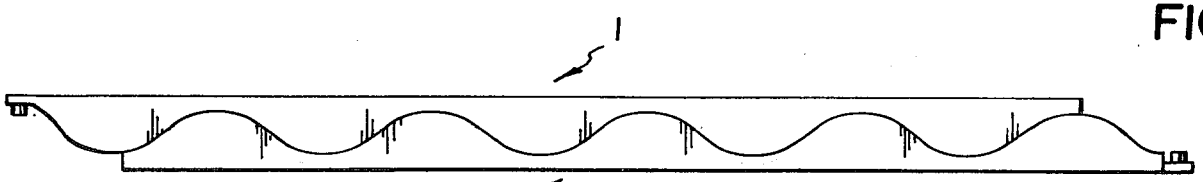
FIG. 5

PLASTIC MOLDING

FIELD OF THE INVENTION

This invention is directed to a sheet molding and in particular a molding that is used to assist in fastening corrugated fibreglass sheeting to supporting objects.

Background of the Invention

Corrugated fibreglass sheeting is widely used in the construction business in forming roofs, fences, patio enclosures and the like. The corrugated design gives the sheets strength. However, there has been a continuing and largely unsatisfactorily solved problem in fastening the corrugated sheeting to supporting objects such as joists, trusses, posts and the like.

The conventional, and only partially satisfactory method, of fastening corrugated plastic sheeting to its support object is to use cedar or other suitable wood strip molding, one longitudinal surface of the molding being corrugated to conform with the corrugations of the plastic sheeting. The corrugated surface of the cedar strip underlies and coincides with the corrugated sheeting, the sheeting then being secured to the support object by driving nails with rubber washers under the heads, through the sheeting, through the underlying cedar strip molding and into the support object.

Since the cedar is under storage for a length of time it dries out and becomes very brittle. It is then prone to splitting when the large diameter nails are driven through the molding and the fibreglass. Once the nails are driven through the fibreglass and the molding, and the molding splits, there is no way to replace the split molding except by removing the overlying fibreglass sheet. Further, the fibreglass sheet is usually ruined when the securing nails are pulled out. As a consequence, any split molding is not manually replaced.

This construction system, however, presents a number of problems. Drilling holes in the molding to accomodate the nails and reduce splitting may be done but this is expensive. The cedar molding also shrinks and warps with time. Furthermore, cedar strip molding is not consistent in size. The dimensions of the corrugations in the molding are customarily cut with planing knives which become dull with use. When the planar knives get dull they must be sharpened. Sharpening the knives necessarily alters their dimensions and hence the dimensions of the corrugations cut in the molding. Inconsistent corrugation dimensions do not provide a good, uniform and load-bearing fit with the fibreglass sheeting corrugations which, because molds are used, tend to be relatively uniform. The non-consistent dimensions of the corrugations in the molding, can be out of size by as little as one-half one thousandth of an inch, and yet this slight discrepancy can provide serious construction problems because, over the length of a normal roof or fence, the corrugations in the molding become increasingly out of step with the corrugations of the sheeting. Thus, in an effort to achieve good fits, many pieces of molding, which normally come in eight foot lengths, must be discarded. Only those pieces of molding which have conforming dimensions can be used. Discarding certain molding sections, and selecting others, is wasteful, expensive and is time consuming for the men constructing and fitting the wall or fence.

A further problem with cedar molding is that the ends are often split, broken off, or generally unsuitable for use, thereby contributing to rejection rates. Moreover, the ends of cedar molding are customarily cut at random and the ends of adjoining molding pieces must be manually matched at the job site, which is time consuming. Sawing the ends of cedar molding to square them, as is done in the trade, also presents a problem because the cut made by the saw has a certain width and thus two pieces with sawn ends may fit too closely together such that the distance between the peaks of the adjacent corrugations does not match corresponding distances between the peaks of other corrugations.

Finally, with cedar corrugated molding, the wood hollowed out to make the corrugations is usually discarded as sawdust, which is wasteful. This is an increasingly serious problem as wood becomes scarce and increases in price over the years.

SUMMARY OF THE INVENTION

I have invented a specific construction of corrugated reinforcing molding strip that is not subject to the problems and shortcomings described above. The strip is formed from a suitable plastic material by injection molding. The strips are relatively short in length, are hollowed out to reduce plastic content, and thus cost, have corrugations that are dimensionally accurate within small tolerances, can be hooked together in series to make up long lengths of molding, and have holes formed in the molding to receive the securing nails, and thereby minimizes splitting.

The molding sections are normally formed in 13 in. lengths (two abutting sections measure 26 ins., which is the customary width of fibreglass sheeting) and have a pair of pin projections formed in one end and matching pin receiving holes in the opposite end. Thus a number of sections can be connected end to end in series by fitting the pin projections at the end of one section into the holes at the end of the adjoining section. The pins and corresponding holes are dimensioned to fit together tightly enough that a number of sections can be linked together to form eight or ten foot strips which are light and can be carried in bundles by a workman up onto the roof of a building, or to wherever the construction site is located. Notwithstanding the snug fit between pins and holes, the sections can still be readily disconnected by hand.

At least two holes for accomodating the molding securing nails are formed in each molded section. Splitting of the molding is therefore virtually eliminated. Furthermore, the pre-molded sections do not shrink or warp with time and when connected together in series provide a long, dimensionally stable molding that snugly fits with the corrugation in a corrugated fibreglass sheet. The molding securing nail receiving holes are formed in the sections at a location off-set from the bottom point of the valley of the corrugations. This facilitates hammering the securing nails, which are of small diameter, through the molding into the underlying support, for example, a joist. If the holes were located at the bottom point of the valley, there would be substantial danger that the hammer would strike the molding on each side of the valley before the nails were driven completely into place thereby damaging the molding. Having the nails off-set substantially reduces this danger.

Once the molding has been secured in place on the support structure, the overlying fibreglass sheeting is put in place and fastened to the molding and the support structure by driving relatively large diameter fibreglass sheet securing nails at periodic crests of corrugations in the fibreglass sheeting.

The pre-molded sections have the additional advantage that they can be packed tightly together by nesting the sections with one another for crating in boxes of about two feet in length. With cedar strips, boxes and crates of about eight feet in length are necessary. On an equivalent basis, the sections, and a strip constructed of linked series of sections of the invention are lighter in weight than the wooden counterparts and may be shipped more economically.

Finally, the pre-molded sections can be manufactured in various colours so that they can be colour matched with the colour of the fibreglass sheeting. Cedar molding must be painted in order to colour match with the colour of the fibreglass sheeting.

The invention consists of a pre-fabricated section suitable for use in supporting corrugated sheeting comprising:

(a) a hollow, open-bottom, elongated body section; the body section having a corrugated top wall and two generally planar side walls;

(b) one or more nail receiving openings penetrating the interior of the corrugated top wall;

(c) a tongue located at and projecting from one end of the body section, the tongue having at least one pin projecting from the surface of the tongue that corresponds with the corrugated surface of the body section; and (d) at least one opening in the corrugated surface corresponding in size and respective location wih the pin located on the tongue at the opposite end, located at the end of the body section opposite the tongue.

The section of the invention wherein the end of the body section having at least one opening for the pin is open to receive within the body section, in end to end relation the tongue of a body section constructed similar to that claimed in the invention.

The section of the invention wherein at least two pins are located on the tongue at one end of the body section and a corresponding number of pin receiving holes are located in the corrugated surface at the end of the body section opposite the two pins.

The section of the invention wherein the nail receiving openings are located in one or more of the sloping surfaces of the corrugated top wall between the apex and valley of the corrugations.

DRAWINGS

In the drawings:

FIG. 1 illustrates a perspective view of a molding section;

Figure 2:
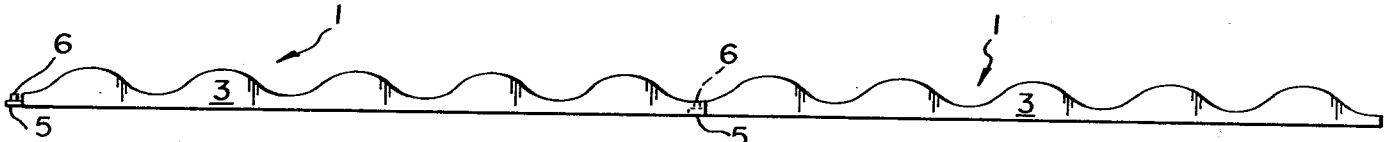
FIG. 2 illustrates a side elevation view of two molding sections linked together.
Figure 2A:
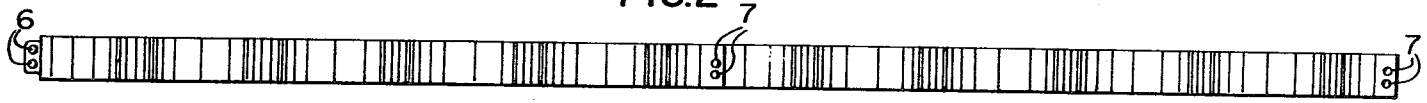
Figure 2B:
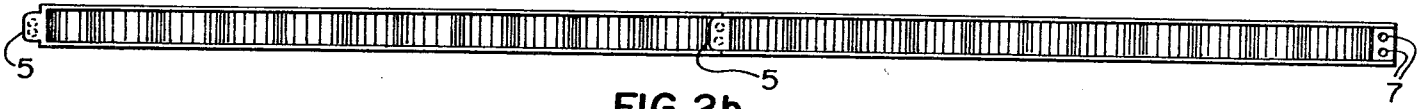
Figure 3:
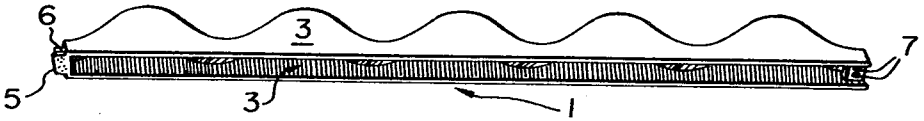

FIG. 2*a* illustrates a top elevation view of two molding sections linked together;

FIG. 2*b* illustrates a bottom elevation view of two molded sections linked together;

FIG. 3 illustrates a perspective view of the underside of a molding section;

FIG. 4, which is found on the first page of the drawings, illustrates a side elevation view of a portion of a molding section, an underlying support object and an overlying sheet secured to the support object by nails and rubber washers; and FIG. 5, which is found on the first page of the drawings, illustrates a side elevation view of two molding sections fitted together for packing and shipping.

DETAILED DESCRIPTION OF ONE EMBODIMENT OF THE INVENTION

With reference to FIG. 1, which illustrates a perspective view of an elongated molding section 1, the section 1 is formed by injection molding with a corrugated top surface 2, dimensioned to fit closely with the corrugation dimensions of commercial corrugated fibreglass sheet, generally planar sides 3, pre-formed nail holes 4, a tongue 5 protruding from one end of the section with a pair of laterally aligned upwardly projecting pins 6 located on the top surface of the tongue 5, and a corresponding pair of pin receiving holes 7 located at the opposite end.

FIGS. 2, 2*a* and 2*b* illustrate how two sections 1 can be snugly and securely linked together in end to end relation by means of pins 6 of one section and pin receiving holes 7 of the next section. The end of section 1 having the holes 7 is open so that it can receive internally tongue 5 and pin pairs 6, pin pairs 6 fitting into the corresponding pair of holes 7 on the end of adjoining section 1.

FIG. 3 illustrates in bottom perspective view the underside of section 1. The underside is hollowed out to leave two relatively thin walls 3. The end of the section 1 with the pair of pin receiving holes 7 is open while the tongue 5 at the opposite end is filled to support the pair of pins 6.

FIG. 4 illustrates in side elevation view the manner in which a section 1 is used to support corrugated sheet 8, in combination with support object 9. Section 1 is first secured to the underlying load bearing support object 9 by means of securing nails 10 at two locations determined by nail holes 4. Sheet 8 is then fastened over the section 1 by fibreglass securing nail 11 which has a head underlying sealing washer 12. Washer 12 provides a seal to prevent water seeping between hole 4 and nail 11.

FIG. 5 illustrates how two, or more, sections 1 can be fitted snugly together for packing into crates for shipping purposes. One section 1 is inverted so that its corrugated surface fits against the corresponding corrugated surface of another section 1. Similar inverted pairs can be stacked up on top of one another, and adjacent one another, for packing into shipping cartons.

The foregoing is a description of only one embodiment of this invention and it is understood that the scope of the invention is not to be limited thereto but is to be evaluated according to the substance and spirit of the invention and the claims which follow this disclosure.

The embodiments of the invention in which an exclusive property or privilege is claimed are defined as follows:

1. A pre-fabricated section suitable for use in supporting corrugated sheeting comprising.

(a) a hollow, open-bottom, elongated body section of a plastic material; the body section having a corrugated top wall and two generally planar side walls;

(b) one or more nail receiving openings penetrating the interior of the corrugated top wall;

(c) a tongue located at and projecting from one end of the body section, the tongue having at least one pin projecting from the surface of the tongue that corresponds with the corrugated surface of the body section; and (d) at least one opening in the corrugated surface corresponding in size and respective location with the pin located on the tongue at the opposite end, located at the end of the body section opposite the tongue.

2. The section of claim 1 wherein the end of the body section having at least one opening for the pin is open to receive within the body section, in end to end relation the tongue of a body section constructed similar to that claimed in claim 1.

3. The section of claim 1 wherein at least two pins are located on the tongue at one end of the body section and a corresponding number of pin receiving holes are located in the corrugated surface at the end of the body section opposite the two pins.

4. The section of claim 1, 2 or 3, wherein the nail receiving openings are located in one or more of the sloping surfaces of the corrugated top wall between the apex and valley of the corrugations.

5. The section of claim 2 wherein at least two pins are located on the tongue at one end of the body section and a corresponding number of pin receiving holes are located in the corrugated surface at the end of the body section opposite the two pins.

6. The section of claim 5, wherein the nail receiving openings are located in one or more of the sloping surfaces of the corrugated top wall between the apex and valley of the corrugations.

* * * * *